US010806303B1

(12) United States Patent
Koumsongo

(10) Patent No.: US 10,806,303 B1
(45) Date of Patent: Oct. 20, 2020

(54) SURFACE PROTECTION ASSEMBLY

(71) Applicant: David Koumsongo, Lakewood, WA (US)

(72) Inventor: David Koumsongo, Lakewood, WA (US)

( * ) Notice: Subject to any disclaimer, the term of this patent is extended or adjusted under 35 U.S.C. 154(b) by 0 days.

(21) Appl. No.: 16/019,718

(22) Filed: Jun. 27, 2018

(51) Int. Cl.
*A47K 1/06* (2006.01)
*A47K 13/16* (2006.01)
*A47K 3/00* (2006.01)

(52) U.S. Cl.
CPC ..... *A47K 1/06* (2013.01); *A47K 13/16* (2013.01); *A47K 3/001* (2013.01)

(58) Field of Classification Search
CPC ..... A47K 1/06; A47K 3/001
USPC ..... 4/580
See application file for complete search history.

(56) References Cited

U.S. PATENT DOCUMENTS 1,987,020 A * 1/1935 Looft ..... A47K 1/06 4/655
3,348,243 A * 10/1967 Kelly ..... A47K 13/16 4/244.3
3,579,669 A * 5/1971 Loeweinstein ..... A47K 13/16 4/244.3
3,938,200 A * 2/1976 Roberts ..... A47K 3/001 4/580
4,106,133 A * 8/1978 Roberts ..... A47K 3/001 4/621
4,956,882 A * 9/1990 Cohn, III ..... A47K 3/002 4/511
5,040,252 A * 8/1991 Taggart ..... A47K 3/001 4/580
5,216,764 A * 6/1993 Hall ..... A47K 3/001 4/244.3
5,465,436 A * 11/1995 Bleicher ..... A47K 3/001 383/206
D455,479 S * 4/2002 Asack ..... A47K 3/38 D23/304
7,600,274 B2 * 10/2009 Washington ..... A47K 3/38 160/124
7,951,292 B1 * 5/2011 De La Torre ..... E03C 1/264 210/164
D653,737 S * 2/2012 Reyes-Silva ..... A47K 3/001 D23/304
9,532,836 B2 * 1/2017 Cornett ..... A61B 50/33
D796,653 S * 9/2017 Hsu ..... A47K 3/001 D23/304
2013/0068770 A1 * 3/2013 Mays-Hornung ..... B65F 1/06 220/495.11

FOREIGN PATENT DOCUMENTS

EP 1996041 A1 12/2008

* cited by examiner

*Primary Examiner* — Lori L Baker
(74) *Attorney, Agent, or Firm* — Sanchelima & Associates, P.A.; Christian Sanchelima; Jesus Sanchelima

(57) ABSTRACT

A surface protection assembly to protect the surface of an article such as bathtubs, urinals, sinks, and utensils. The surface protection assembly includes a thin, flexible protective layer configured to attach onto a surface of the article. The protective layer is made of clingy plastic material. The protective layer enables a user to handle the article without a risk of the article's surface being deteriorated. The protective layer could be readily removed from the article surface along with the accumulated dirt or bacteria, after each usage.

11 Claims, 4 Drawing Sheets

SURFACE PROTECTION ASSEMBLY

BACKGROUND OF THE INVENTION

1. Field of the Invention

The present disclosure relates to a surface protection assembly for protecting an article surface. More specifically, the present disclosure relates to a surface protection assembly, comprising a thin flexible layer configured to attach onto a surface of the article, for example, bathtubs, sinks, etc.

2. Description of the Related Art

Surface cleaning and polishing of daily-use articles, such as bathtubs, tiles in bathrooms, urinals, sinks, and dishes are compulsory for a hygienic lifestyle. Conventional method of maintaining cleanliness of articles involves liquid spraying of a cleaning solution, scrubbing its surface and vacuuming the residue. Few unavoidable problems with the conventional cleaning method includes discolouring and damage of the articles on scrubbing, breakage of articles due to inadvertent slip, which require more manual effort. Further cleaning of articles such as sinks, urinals, involve disposal of waste and other garbage to prevent clogging of the sink drain. This messy, unsavoury process must be generally done by hand, which must be avoided if possible.

Several devices have been designed in the past. None of them, however, include a surface protection assembly that is capable of addressing the foregoing discussed issues.

Applicant believes that a related reference corresponds to U.S. Pat. No. 5,216,764A filed by Horace Hall et. al describes a disposable bathtub and shower liner. The Horace reference teaches a bathtub and shower liner ensemble comprised of thin, flimsy, disposable, sterile, contoured, impervious, plastic film sheers, with a bottom mat-like sheet secured to bathtub or shower basin to provide cushion and comfort. The entire liner assembly is compressed to form a single, thin, flexible, chaise lining, which is contoured to fit removably into the bathtub on the bottom, sides, ends, and top surfaces. However, the Horace reference is limited to use as a disposable and protective liner for bathtub and shower.

Another related reference is EP patent application number 1996041A1 filed by Jacques Andre et. al for an article wrapped in a protective film. The Jacques reference teaches protection of objects or articles such as wristwatches that are typically handled during transportation, display and demonstration at points-of-sale and whose outer appearance is likely to be deteriorated when the object is handled. However, the Jacques reference fails to provide solution for protecting daily-use articles, such as bathtubs, tiles in bathrooms, urinals, sinks, and plates.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a surface protection assembly comprising a thin, flexible protective layer adapted to secure over a surface of an article, to keep the article clean and hygiene.

It is another object of the present invention to provide the surface protection assembly comprising the flexible protective layer, which is configured to skin-wrap against the surface of the article.

It is yet another object of the present invention to provide the surface protection assembly that enables a user to utilize the article without any risk of deteriorating the article surface.

It is yet another object of the present invention to provide the surface protection assembly that enables the user to readily peel off the protective layer from the article, after each usage.

It is yet another object of the present invention to provide the surface protection assembly comprising the protective layer made of disposable, clingy type plastic material.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1A:
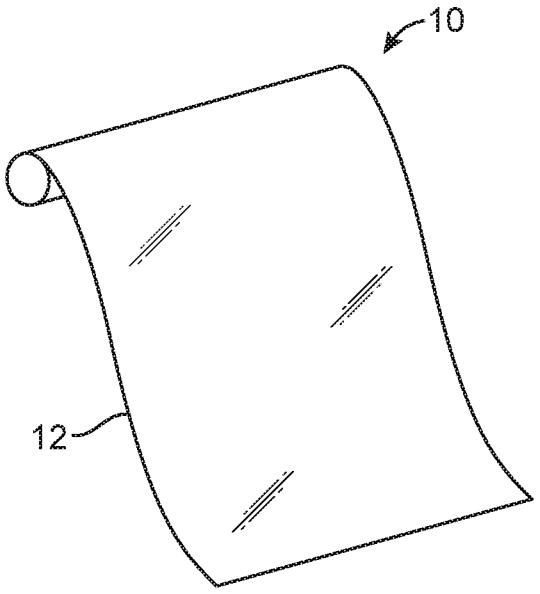
FIG. 1A exemplarily illustrates a perspective view of a roll of surface protection assembly 10, according to an embodiment of the present invention. The surface protection assembly 10 comprises a thin, flexible protective layer 12, is illustrated.
Figure 1B:
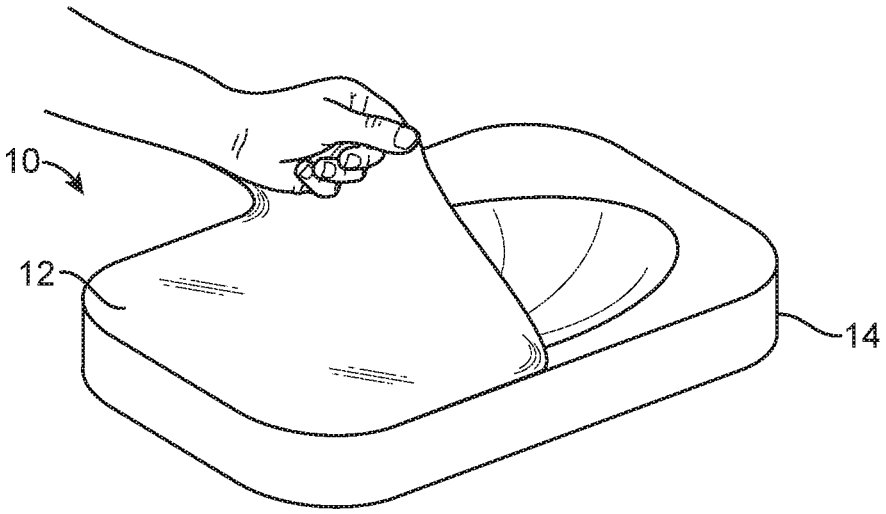
FIG. 1B exemplarily illustrates securing of protective layer 12 of the surface protection assembly 10 over an article 14 such as conventional sink or wash basin by a user, according to an embodiment of the present invention.
Figure 2A:
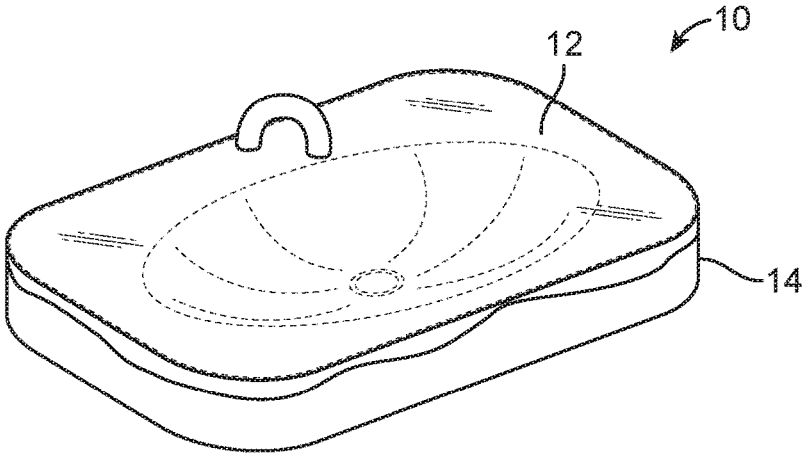
FIG. 2A exemplarily illustrates a perspective view of the surface protection assembly 10 secured over the article 14 such as conventional sink or wash basin, according to an embodiment of the present invention. The surface protection assembly 10 comprising the protective layer 12 is skin-wrapped against the surface of the conventional wash basin, is illustrated.
Figure 2B:
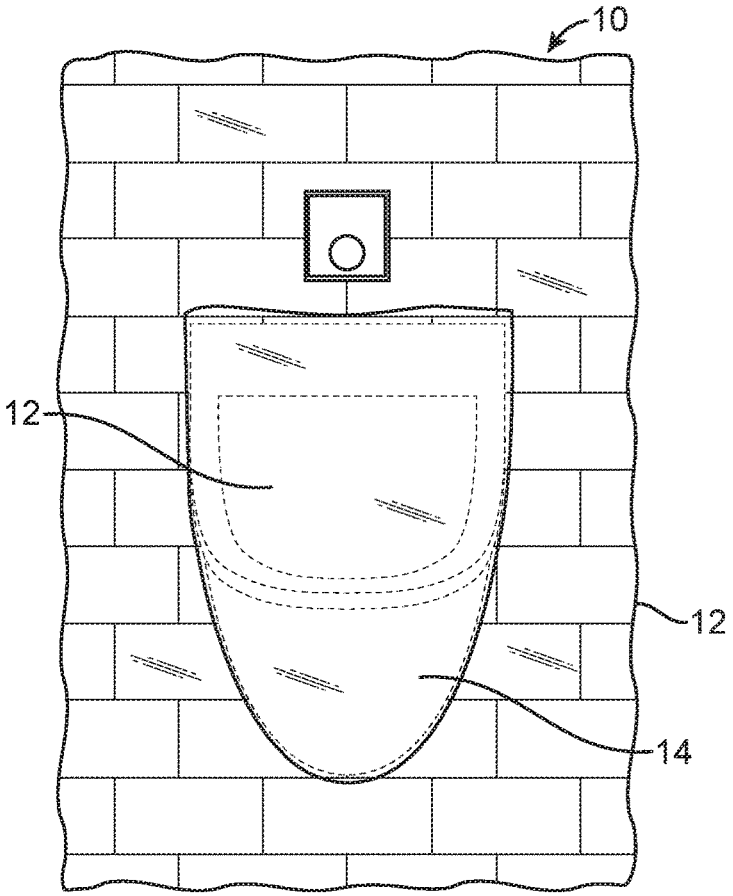
FIG. 2B exemplarily illustrates a perspective view of the surface protection assembly 10 secured over the article 14 such as conventional urinal surface and bathroom wall tiles, according to an embodiment of the present invention. The protective layer 12 of the surface protection assembly 10 is skin-wrapped against the surface of the conventional urinal surface and bathroom wall tiles, is illustrated.
Figure 2C:
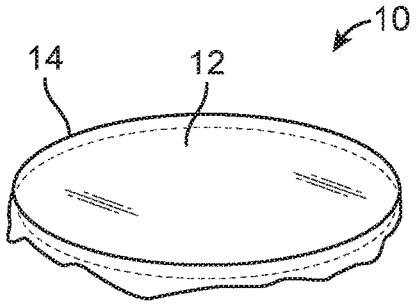
FIG. 2C exemplarily illustrates a perspective view of the surface protection assembly 10 secured over the article 14 such as conventional plate surface, according to an embodiment of the present invention. The protective layer 12 of the surface protection assembly 10 is skin-wrapped against the surface of the conventional plate surface, is illustrated.
Figure 3A:
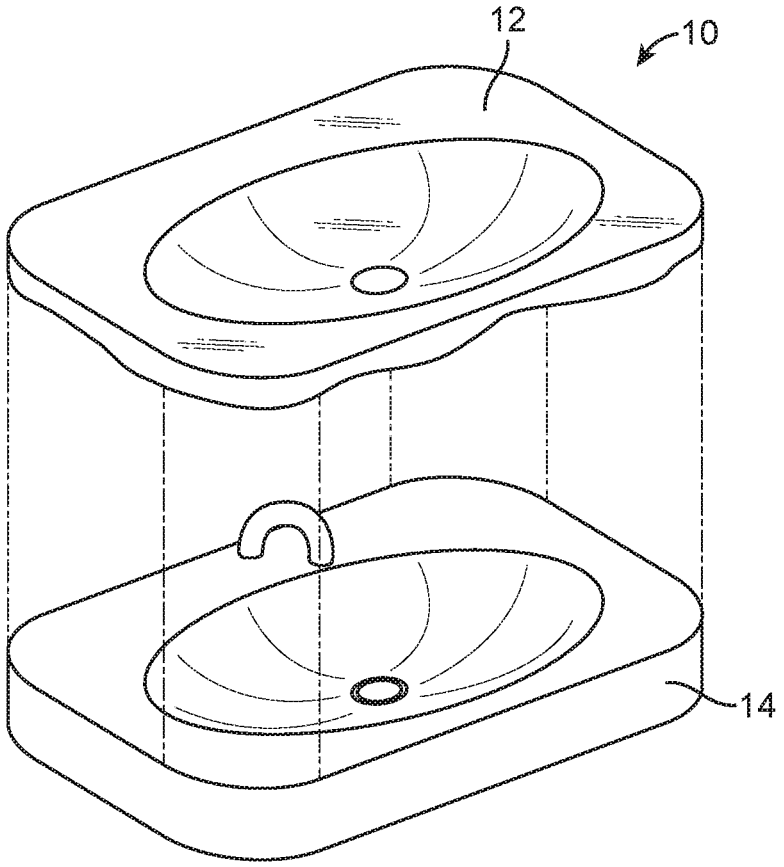
FIG. 3A exemplarily illustrates an exploded view of the surface protection assembly 10 secured over the article 14 such as conventional sink or wash basin, according to an embodiment of the present invention.
Figure 3B:
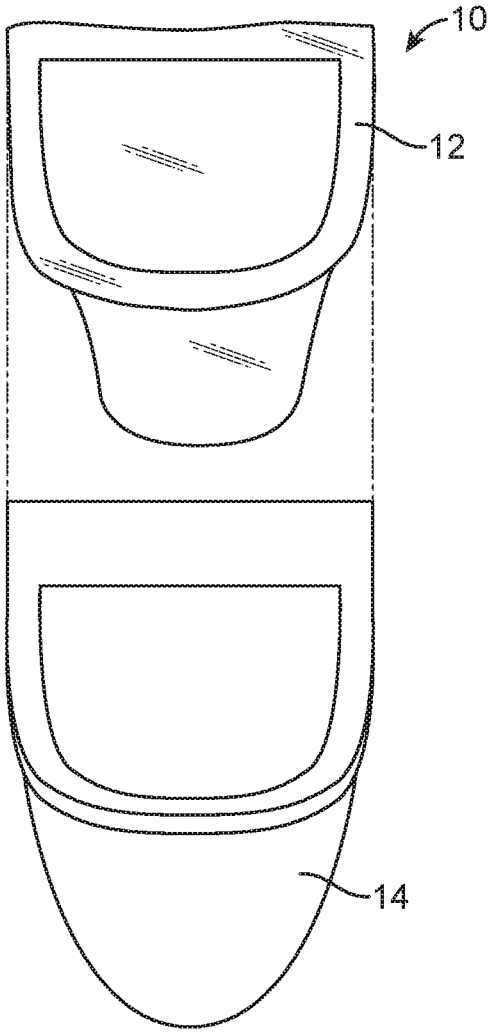
FIG. 3B exemplarily illustrates an exploded view of the surface protection assembly 10 secured over the article 14 such as conventional urinal surface, according to an embodiment of the present invention.
Figure 3C:
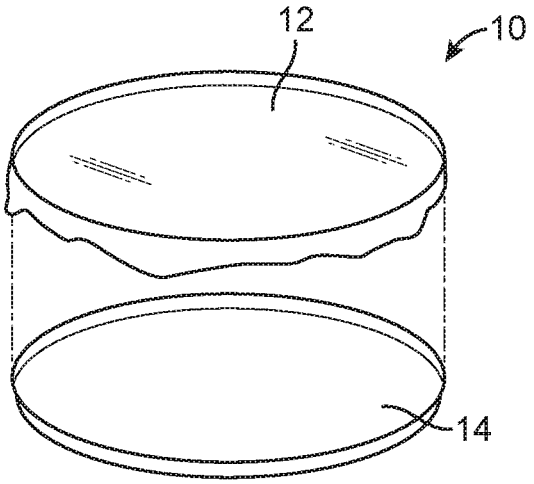
FIG. 3C exemplarily illustrates an exploded view of the surface protection assembly 10 secured over the article 14 such as conventional plate surface, according to an embodiment of the present invention.

Referring now to the drawings, FIGS. 1A-3C, where the present invention is generally referred with numeral 10, it can be observed that a surface protection assembly 10 to protect surface of an article 14, is disclosed. The surface protection assembly 10 comprises a thin, flexible protective layer 12 configured to attach onto a surface of the article 14. The protective layer 12 enables a user to handle the article 14 without any risk of the article's surface being scratched or otherwise deteriorated.

The protective layer 12 could be shaped to substantially match a contour of the article 14. In an embodiment, the protective layer 12 is made of clingy plastic material, which obviates a need of bond or adhesive between the layer 12 and article surface. The protective layer 12 further could be readily removed from the article 14 along with the accumulated dirt or bacteria, when the need to protect its surface ceases. In one embodiment, the article 14 includes, but not limited to, urinal, plate, sink, bathroom wall, bathtub, shower, watch, bracelet, leather, leather-containing article, article made of precious metal, lighter, medal, jewelry item, and communication device.

During use of the surface protection assembly 10, the protective layer 12 is applied over and beyond a front face of an article 14. Then, the protective layer 12 is skin-wrapped against the surface of the article 14, so that the layer 12 matches the contour of the article surface. Further, the side portions of the protective layer 12 extending from the front surface could be folded to wrap the article 14. The protective layer 12 is removed easily from the article 14 via peeling, after usage. This removal process, strips away all accumulated dirt or any bacteria, and maintain the article surface as clean and sterile surface. Conventional time and manual effort required to clean and sterilize the article surface are eliminated.

In one embodiment, the protective layer 12 is made of plastic material, but not limited to a bioplastic material. In one embodiment, the protective layer 12 is made of clingy type of plastic material. In another embodiment, the protective layer 12 is made of thin, flexible material. In another embodiment, the protective layer 12 is made of eco-friendly, disposable, biodegradable material. In one embodiment, the protective layer 12 comprises elastic edges. In one embodiment, the protective layer 12 is 60" width, 84" length and 7 ft height. In one embodiment, the protective layer 12 could be manufactured in any shape and size. In one embodiment, the protective layer 12 is made of impervious material. In some embodiments, the protective layer 12 is made of transparent material. In one embodiment, the protective layer 12 could be distributed in the market with selective bright colors attractive to the consumers, or matching colors and pattern respective to the articles.

Advantageously, the present invention could be used on article 14 comprising regular or irregular shaped surface to be protected against scratching and other deterioration. The surface protection assembly 10 of the present invention provides a comfortable, sanitary environment, as well as the convenience of removing dirt, or any infectious microorganisms. The surface protection assembly 10 could be easily disposable and recycled. Applying the protective layer 12 onto bathtub, urinal, wall, sink, eliminates the time and effort necessary to clean, disinfect, and sterilize after each use. Also, the present invention saves water and reduces an amount of chemical or soaps dumped into waste water runoff. Further, the protective layer 12 could be used in common households, motels, hotels, retirement homes, public spas, restaurants, military bases, schools at any level, and health-care institutions.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A surface protection assembly for an article, comprising:

A single thin flexible protective layer configured to attach onto a surface of the article, thereby enabling to maintain a clean and hygienic article surface, wherein said single thin flexible protective layer is provided in a roll, wherein said single thin flexible protective layer is pulled from said roll and cut to provide a rectangular single thin flexible protective layer, wherein said article is a shower stall, a sink top surface or a dinning plate, wherein said single thin flexible protective layer includes side portions extending partially along sidewalls of said article, wherein said single thin flexible protective layer is skin-wrapped against the surface of said article such that said single thin flexible protective layer matches a contour of said surface.

2. The surface protection assembly of claim 1, wherein the protective layer is made of plastic material.

3. The surface protection assembly of claim 1, wherein the protective layer is made of a clingy plastic material.

4. The surface protection assembly of claim 1, wherein the protective layer is made of bioplastic material.

5. The surface protection assembly of claim 1, wherein the size of protective layer is 60" width, 84" length and 7 ft height.

6. The surface protection assembly of claim 1, wherein the protective layer comprises elastic edges.

7. The surface protection assembly of claim 1, wherein the protective layer is of rectangular shape.

8. The surface protection assembly of claim 1, wherein the protective layer is of circular shape.

9. The surface protection assembly of claim 1, wherein the protective layer further comprises selective color and pattern.

10. The surface protection assembly of claim 1, wherein the article includes watch, bracelet, leather, leather-containing article, article made of precious metal, lighter, medal, jewelry item, communication device, urinal, bathroom wall, plate, sink or any combinations thereof.

11. A surface protection assembly for an article, comprising:

a. a sink having a top surface having a recessed bowl with a drain hole, said recessed bowl defined by raised sidewalls to create an oval shape; and b. a flexible protective layer attached to said sink, said flexible protective layer including an indented portion that exactly matches the shape of the recessed bowl, said flexible protective layer includes a drain hole cover section that has dimensions that exactly match the dimensions of the sink drain hole, thereby providing a user with a guide as to where to mount said flexible protective layer, said recessed bowl includes a bowl depth, said indented portion includes an indented depth, said bowl depth is equal to said indented depth, said drain hole is circular, said flexible protective layer includes excess material that drapes off the entire perimeter of said flexible protective layer, thereby creating a seal between said flexible protective layer and said sink, said excess material extends a sufficient length past the top surface of said sink so that a user can easily remove said flexible protective layer, said sink includes rounded edges, said flexible protective layer includes rounded edges that include the same curvature as the rounded edges of said sink;

said top surface of said sink, thereby enabling to maintain a clean and hygienic sink, wherein said flexible protective layer includes side portions, said side portions extending partially below a top end of said sidewalls of said sink, wherein said side portions extend entirely along said sidewalls of said sink, wherein said flexible protective layer is skin wrapped against the surface of said sink to such that said flexible protectives layer matches a contour of said top surface of said sink.

* * * * *